US008963032B2

(12) United States Patent
Yuan

(10) Patent No.: US 8,963,032 B2
(45) Date of Patent: Feb. 24, 2015

(54) BUTTON ASSEMBLY FLUSH WITH ELECTRONIC DEVICE CASING

(71) Applicant: Wistron Corporation, New Taipei (TW)

(72) Inventor: Peter Yuan, New Taipei (TW)

(73) Assignee: Wistron Corporation, Hsichih, New Taipei (TW)

( * ) Notice: Subject to any disclaimer, the term of this patent is extended or adjusted under 35 U.S.C. 154(b) by 138 days.

(21) Appl. No.: 13/776,718

(22) Filed: Feb. 26, 2013

(65) Prior Publication Data

US 2014/0008194 A1 Jan. 9, 2014

(30) Foreign Application Priority Data

Jul. 9, 2012 (CN) ..... 2012 1 0237576

(51) Int. Cl.

| | |
|---|---|
| ***H01H 3/12*** | (2006.01) |
| ***H01H 13/02*** | (2006.01) |
| ***H01H 13/14*** | (2006.01) |
| ***H01H 13/52*** | (2006.01) |

(52) U.S. Cl.

CPC ..... *H01H 13/02* (2013.01); *H01H 13/14* (2013.01); *H01H 13/52* (2013.01); *H01H 3/122* (2013.01); *H01H 2221/05* (2013.01); *H01H 2221/058* (2013.01); *H01H 2223/012* (2013.01)

USPC ..... 200/341

(58) Field of Classification Search

USPC ..... 200/296, 341, 345

See application file for complete search history.

(56) References Cited

U.S. PATENT DOCUMENTS

| | | | | |
|---|---|---|---|---|
| 4,480,163 | A * | 10/1984 | Morris et al. | 200/331 |
| 5,442,152 | A * | 8/1995 | Huang | 200/345 |
| 2009/0217719 | A1 | 9/2009 | Liu | |

FOREIGN PATENT DOCUMENTS

| | | |
|---|---|---|
| TW | M285016 | 1/2006 |
| TW | 201005778 | 2/2010 |
| TW | M376820 U1 | 3/2010 |

OTHER PUBLICATIONS

Office action mailed on Apr. 7, 2014 for the Taiwan application No. 101126011, filing date: Jul. 19, 2012, p. 1 line 12-14, p. 2-5 and p. 6 line 1-7 .

* cited by examiner

*Primary Examiner* — Vanessa Girardi
(74) *Attorney, Agent, or Firm* — Winston Hsu; Scott Margo

(57) ABSTRACT

A button mechanism includes a casing, a frame, a fixing structure, a button and at least one resilient component. An opening is formed on the casing. The frame is installed inside the casing and located in a position corresponding to the opening. The fixing structure is disposed on the casing for fixing the frame. The button is installed inside the frame. The button includes a main body and an actuating portion connected to a side of the main body. The actuating portion passes through the hole on the frame as the main body is pressed down in a first direction, so as to actuate a switch. The resilient component is installed inside the frame, and two ends of the resilient component contact against an inner side of the frame and the main body respectively, so as to drive the button to move in a direction opposite to the first direction.

18 Claims, 7 Drawing Sheets

BUTTON ASSEMBLY FLUSH WITH ELECTRONIC DEVICE CASING

BACKGROUND OF THE INVENTION

1. Field of the Invention

The present invention relates to a button mechanism, and more specifically, to a button mechanism with easy assembly and reworking capability.

2. Description of the Prior Art

A button of a laptop computer in the marketplace is often designed with an elastic arm structure connected to a structure component of a case in a heat melt manner, so that the button can be pressed and rebound back. For example, a mechanical design integrates a bezel and a button via an elastic structure disclosed in U.S. patent Publication No. 2009/0217719. However, if the button connected to the structure component in a heat melt manner needs to be replaced, such as appearance of the button being scratched in transportation or assembly, because the button cannot be detached directly, that is the button has no capability of reworking, the whole case with the structure component needs to be replaced. As a result, it causes waste in cost and inconvenience of assembly.

SUMMARY OF THE INVENTION

The present invention is to provide a button mechanism with easy assembly and reworking capability to solve above problems.

According to the disclosure, the button mechanism includes a casing, a frame, a fixing structure, a button and at least one resilient component. An opening is formed on the casing. The frame is installed inside the casing and located in a position corresponding to the opening, and a hole is formed on the frame. The fixing structure is disposed on the casing for fixing the frame. The button is installed inside the frame and located in a position corresponding to the opening. The button includes a main body and an actuating portion. The actuating portion is connected to a side of the main body, and the actuating portion is passing through the hole on the frame as the main body is pressed in a first direction, so as to actuate a switch. The at least one resilient component is installed inside the frame, and two ends of the at least one resilient component contacts against an inner side of the frame and the main body respectively, so as to drive the button to move in a direction opposite to the first direction.

According to the disclosure, at least one engaging hole is formed on a lateral wall of the frame, and the fixing structure includes at least one hook for engaging with the at least one engaging hole, so as to constrain a movement of the frame in the first direction.

According to the disclosure, the fixing structure further includes at least one protruding rib disposed at a side of the opening, and the at least one protruding rib is for constraining a movement of the main body of the button in a direction vertical to the first direction.

According to the disclosure, the at least one hook is connected to a side of the at least one protruding rib far away from the opening.

According to the disclosure, the frame includes at least one guiding portion, the button further includes an extension portion and at least one constraining portion, the extension portion is connected to a side of the main body for contacting against an inner side of the casing as the at least one resilient component drives the button to move in the direction opposite to the first direction so as to prevent the button from separating from the opening, the at least one constraining portion is connected to the extension portion and installed inside the at least one guiding portion, and the at least one guiding portion of the frame is for guiding the at least one constraining portion to move in the first direction.

According to the disclosure, the at least one guiding portion and the at least one constraining portion are respectively a U-shaped guiding track and an extension rib.

According to the disclosure, as the extension portion contacts against the inner side of the casing, a surface of the main body of the button is substantially aligned with an outer surface of the casing.

According to the disclosure, at least one aperture is further formed on the frame, the button further includes at least one guiding pillar connected to the side of the main body via passing through the at least one aperture, and the at least one resilient component sheathes the at least one guiding pillar.

According to the disclosure, an electronic device includes a circuit board, a button mechanism. A switch is disposed on the circuit board. The button mechanism is for actuating the switch. The button mechanism includes a casing, a frame, a fixing structure, a button and at least one resilient component. An opening is formed on the casing. The frame is installed inside the casing and located in a position corresponding to the opening, and a hole is formed on the frame. The fixing structure is disposed on the casing for fixing the frame. The button is installed inside the frame and located in a position corresponding to the opening. The button includes a main body and an actuating portion. The actuating portion is connected to a side of the main body, and the actuating portion is passing through the hole on the frame as the main body is pressed in a first direction, so as to actuate a switch. The at least one resilient component is installed inside the frame, and two ends of the at least one resilient component contacts against an inner side of the frame and the main body respectively, so as to drive the button to move in a direction opposite to the first direction.

The button mechanism of the present invention utilizes the detachable frame to fasten the button inside the casing and utilizes the resilient component contacting against the frame and the button to provide the button with a pressing and returning mechanism, so as to improve the problem of no reworking capability of a conventional mechanism with a flexible arm structure connected to the casing in a heat melt manner. That is, it only needs to detach the frame and install a new button without replacing any other appearance component of the casing when replacing the old button, so as to save assembly cost efficiently and increase assembly convenience.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
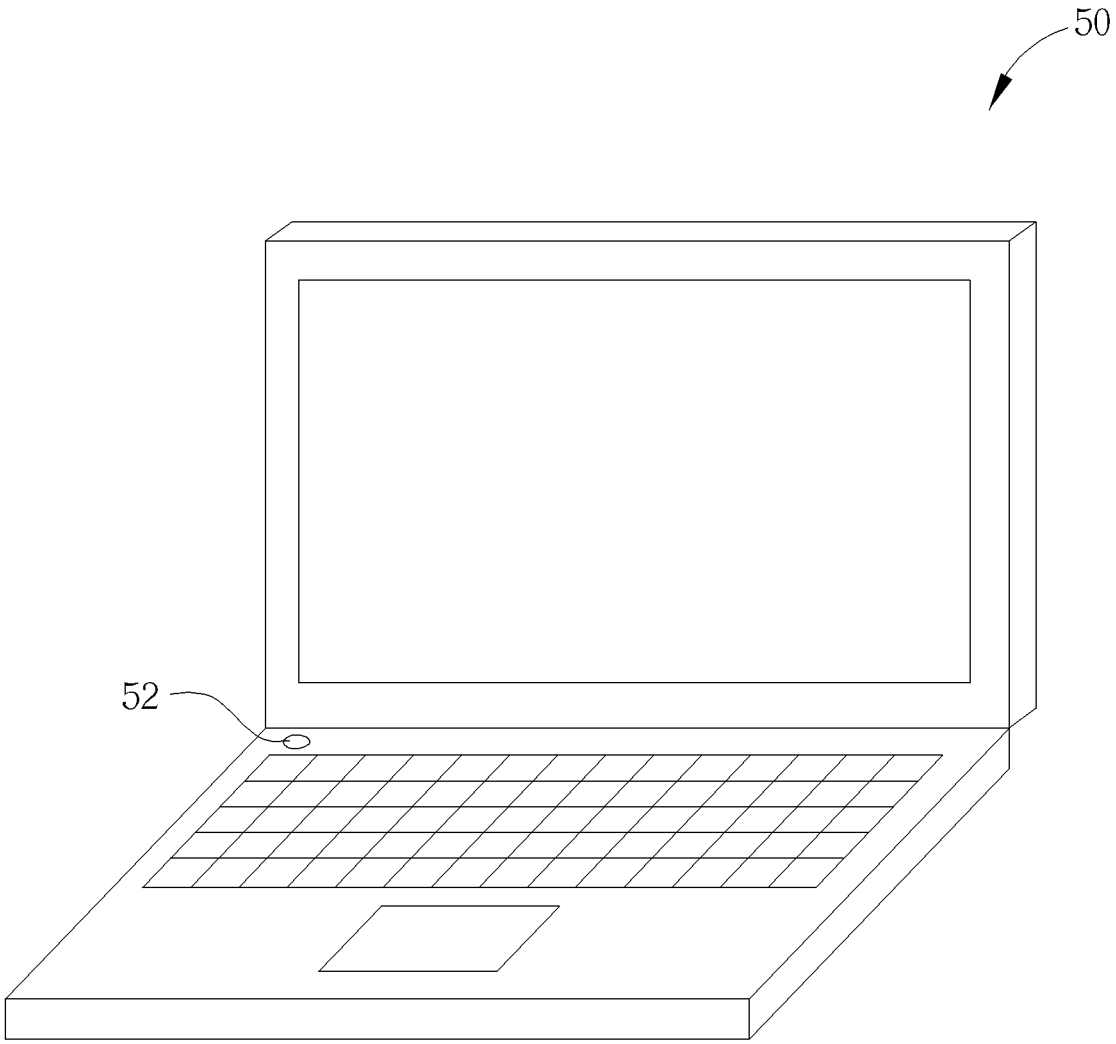
FIG. 1 is a diagram of an electronic device according to an embodiment of the present invention.
Figure 2:
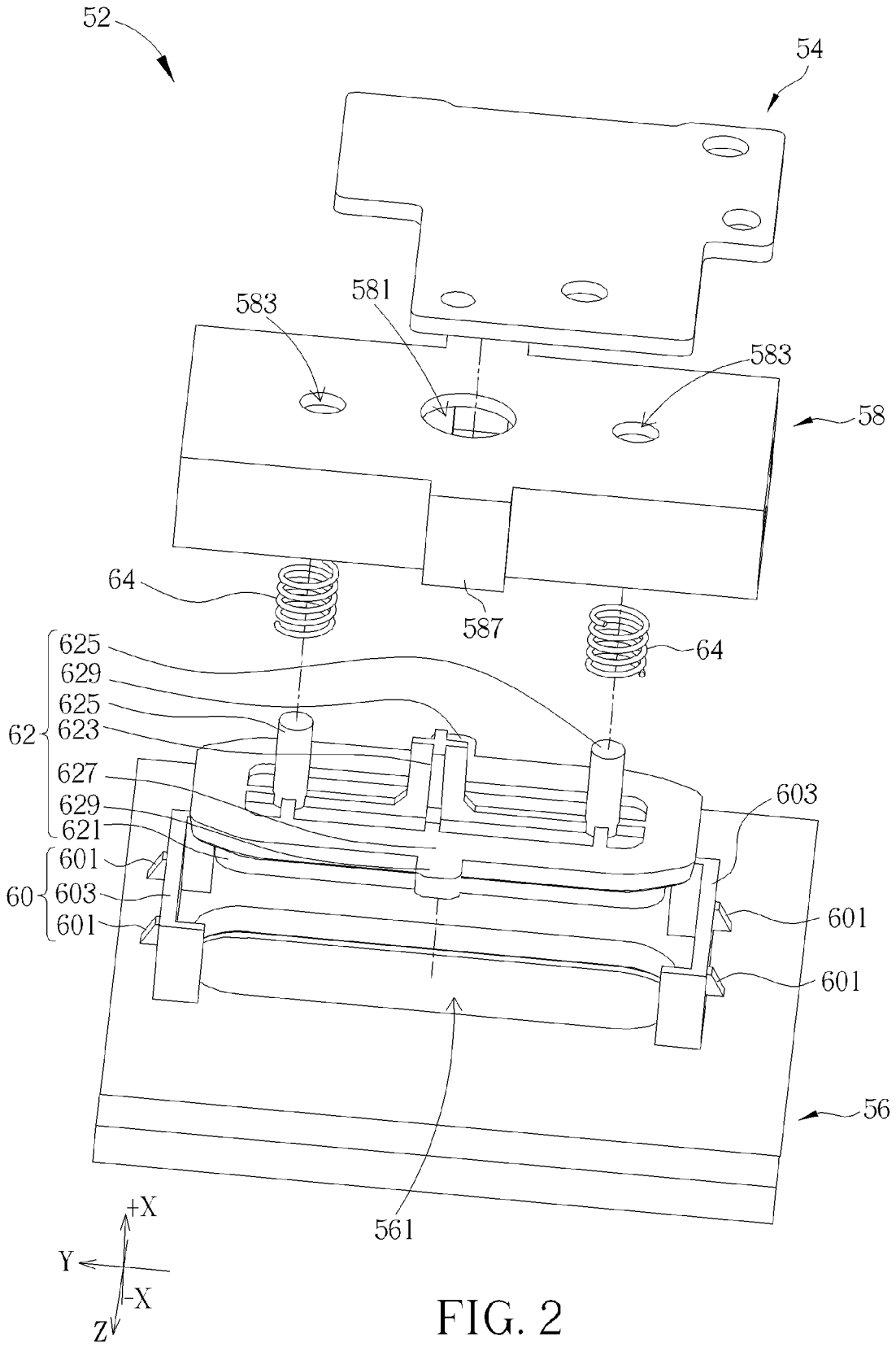
FIG. 2 is an exploded diagram of a button mechanism according to the embodiment of the present invention.
Figure 3:
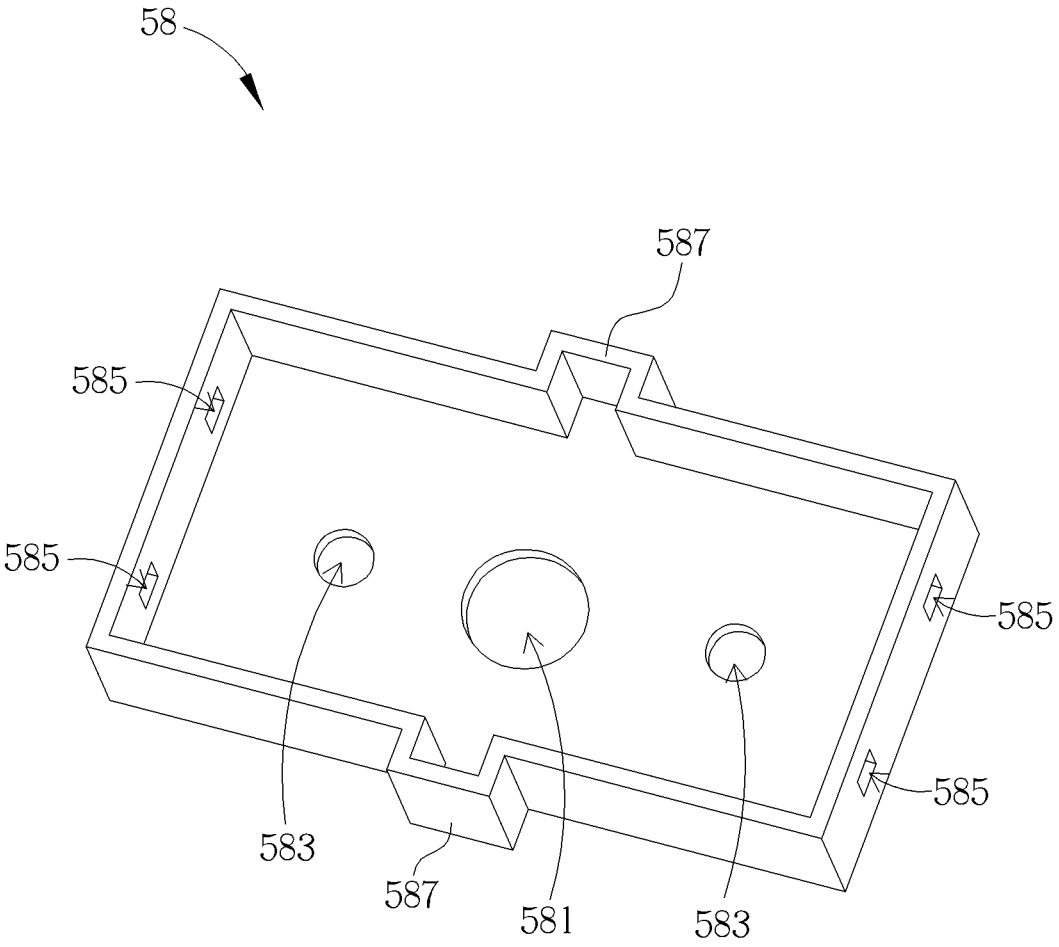
FIG. 3 is a diagram of a frame according to the embodiment of the present invention.

Please refer to FIG. 1. FIG. 1 is a diagram of an electronic device 50 according to an embodiment of the present invention. The electronic device 50 can be a computer device, such as a notebook computer. The electronic device 50 includes a button mechanism 52 to generate a corresponding ON or OFF signal as being pressed by users. The button mechanism 52 can be a power switch mechanism. Please refer to FIG. 2. FIG. 2 is an exploded diagram of the button mechanism 52 according to the embodiment of the present invention. The electronic device 50 further includes a circuit board 54, and the button mechanism 52 is for pressing and actuating a switch component on the circuit board 54, so as to generate the corresponding ON or OFF signal. The button mechanism 52 includes a casing 56, a frame 58, a fixing structure 60, a button 62 and at least one resilient component 64. An opening 561 is formed on the casing 56, and the casing 56 can be an appearance component of the electronic device 50. Please refer to FIG. 2 and FIG. 3. FIG. 3 is a diagram of the frame 58 according to the embodiment of the present invention. The frame 58 is installed inside the casing 56 and located in a position corresponding to the opening 561. A hole 581, at least one aperture 583, at least one engaging hole 585, and at least one guiding portion 587 are formed on the frame 58.

The fixing structure 60 is disposed on the casing 56 for fixing the frame 58. For example, the fixing structure 60 can include at least one hook 601 for engaging with the at least one engaging hole 585 on the frame 58, so as to constrain a movement of the frame 58 in a first direction (+X direction). In this embodiment, four engaging holes 585 are formed on lateral walls of the frame 58 for engaging with the four hooks 601 respectively. Positions and amounts of the engaging hole 585 and the hook 601 are not limited to this embodiment, and it depends on practical design demands. In addition, the fixing structure 60 further includes at least one protruding rib 603 disposed at a side of the opening 561, and the at least one protruding rib 603 is for constraining a movement of the button 62 in directions (Y direction and Z direction) vertical to the first direction (+X direction), so that the button 62 does not sway on a Y-Z plane of an inner side of the casing 56 in operation. In this embodiment, the fixing structure 60 includes two protruding rib 603 disposed at two sides of the opening 561 respectively. Each hook 601 is connected to a side of the corresponding protruding rib 603 far away from the opening 561. Positions and amounts of the protruding rib 603 are not limited to this embodiment, and it depends on practical design demands.

Moreover, the button 62 is installed inside the frame 58 and located in the position corresponding to the opening 561. The button 62 includes a main body 621, an actuating portion 623, at least one guiding pillar 625, an extension portion 627, and at least one constraining portion 629. The main body 621 is disposed on the position corresponding to the opening 561, and the users can press the main body 621 to operate the button mechanism 52. The actuating portion 623 is connected to aside of the main body 621. The actuating portion 623 can be a protruding pillar structure and pass through the hole 581 of the frame 58 as the main body 621 is pressed downward in the first direction (+X direction). The guiding pillar 625 is connected to the side of the main body 621 for passing through the corresponding aperture 583, so as to guide the button 62 to move stably relative to the frame 58 in the first direction (+X direction) with combination of the guiding pillar 625 and the aperture 583. As a result, it can ensure the button 62 does not sway on the Y-Z plane of the inner side of the casing 56 as the button 62 is in operation. In this embodiment, the button mechanism 52 includes two sets of the guiding pillars 625 and the apertures 583 disposed at two sides of the actuating portion 623 and the hole 581 symmetrically. Positions and amounts of the guiding pillar 625 and the aperture 583 are not limited to this embodiment, and it depends on practical design demands.

In addition, the extension portion 627 is connected to the side of the main body 621. That is, the extension portion 627 can be a skirt structure connected to the main body 621. The extension portion 627 is for contacting against the inner side of the casing 56 as the extension portion 627 moves in a direction (−X direction) opposite to the first direction, so as to prevent the button 62 from separating from the opening 561. As the extension portion 627 is contacting against the inner side of the casing 56, a surface of the main body 621 of the button 62 can be designed to substantially align with an outer surface of the casing 56, so as to maintain uniformity of overall appearance of the button mechanism 52 without any step. The constraining portion 629 is connected to the extension portion 627 and installed inside the guiding portion 587 of the frame 58. The guiding portion 587 is for guiding the constraining portion 629 to move in the first direction (+X direction), so that the button 62 does not sway on the Y-Z plane of the inner side of the casing 56 as the button 62 is in operation. The guiding portion 587 and the constraining portion 629 can respectively be a U-shaped guiding track and an extension rib extending from the extension portion 627. In this embodiment, the button mechanism 52 includes two sets of the guiding portions 587 and the constraining portions 629. Positions and amounts of the guiding portion 587 and the constraining portion 629 are not limited to this embodiment, and it depends on practical design demands. Furthermore, the resilient component 64 can be a spring component and can sheathe the corresponding guiding pillar 625. Two ends of the resilient component 64 contact against an inner side of the frame 58 and the main body 621 of the button 62 respectively, so as to support the button 62 as the button 62 has not been pressed downward yet. Besides, the resilient component 64 can sheathe the actuating portion 623 selectively and can be further for driving the button 62 in the −X direction to restore the button 62.

Figure 4:
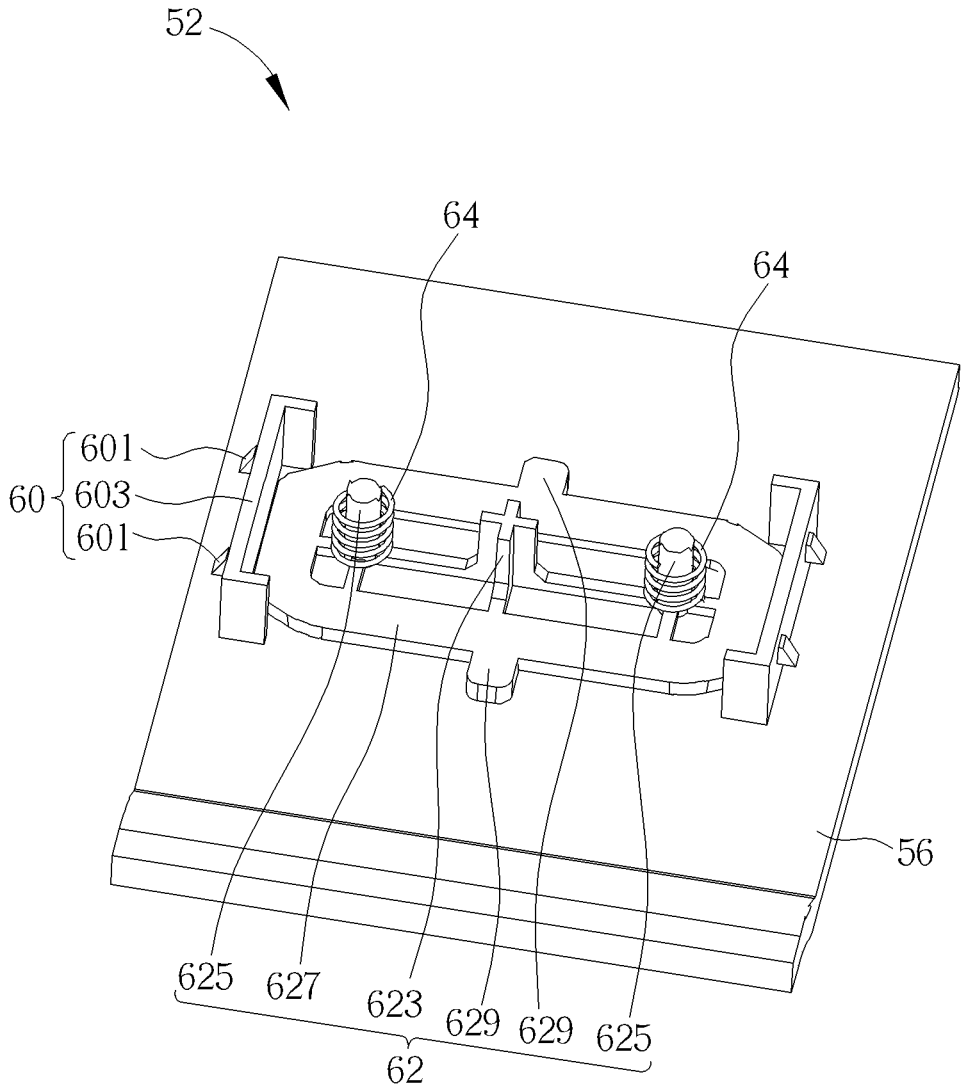
FIG. 4 and FIG. 5 are assembly diagrams of the button mechanism according to the embodiment of the present invention.
Figure 5:
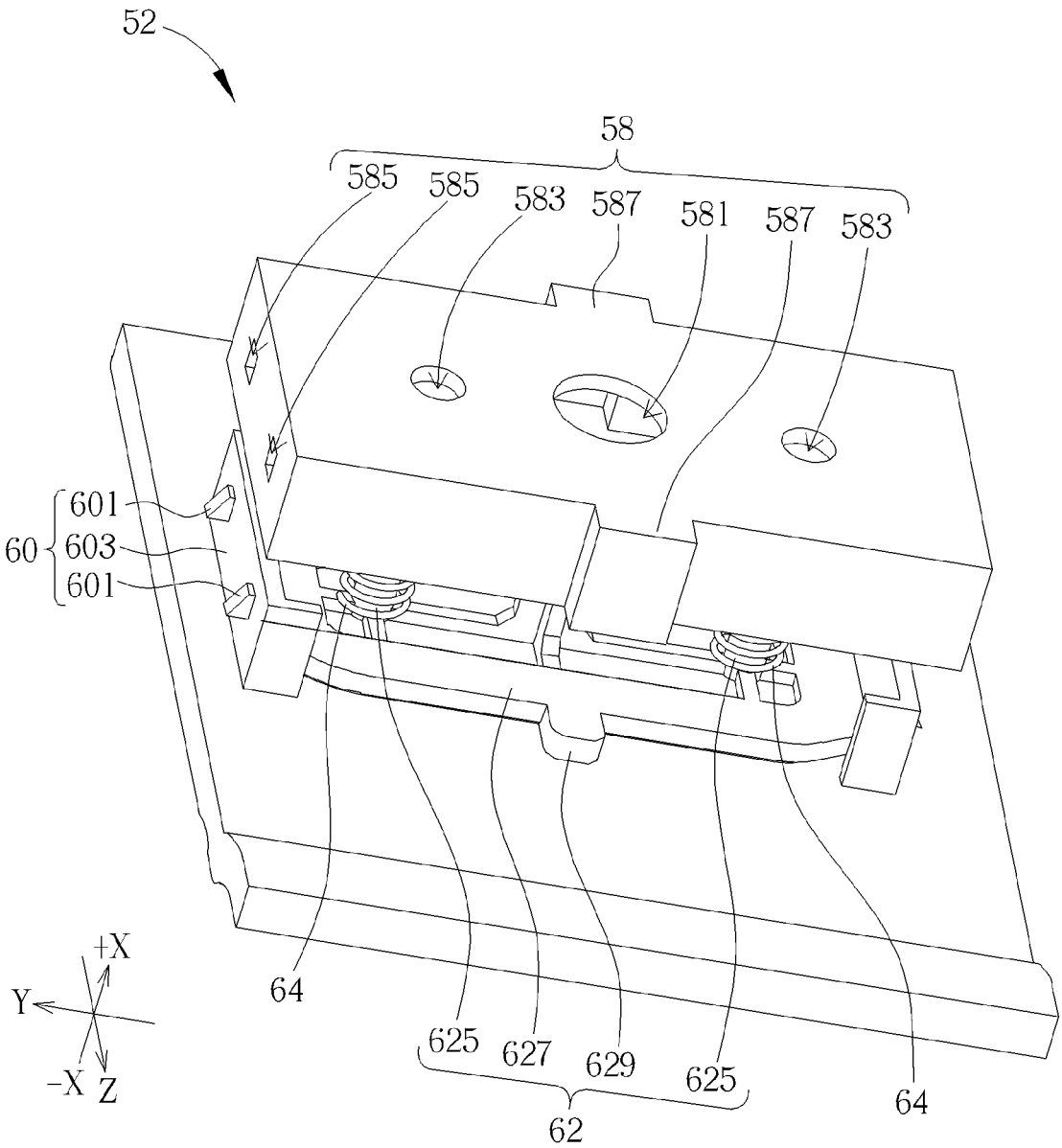
Figure 6:
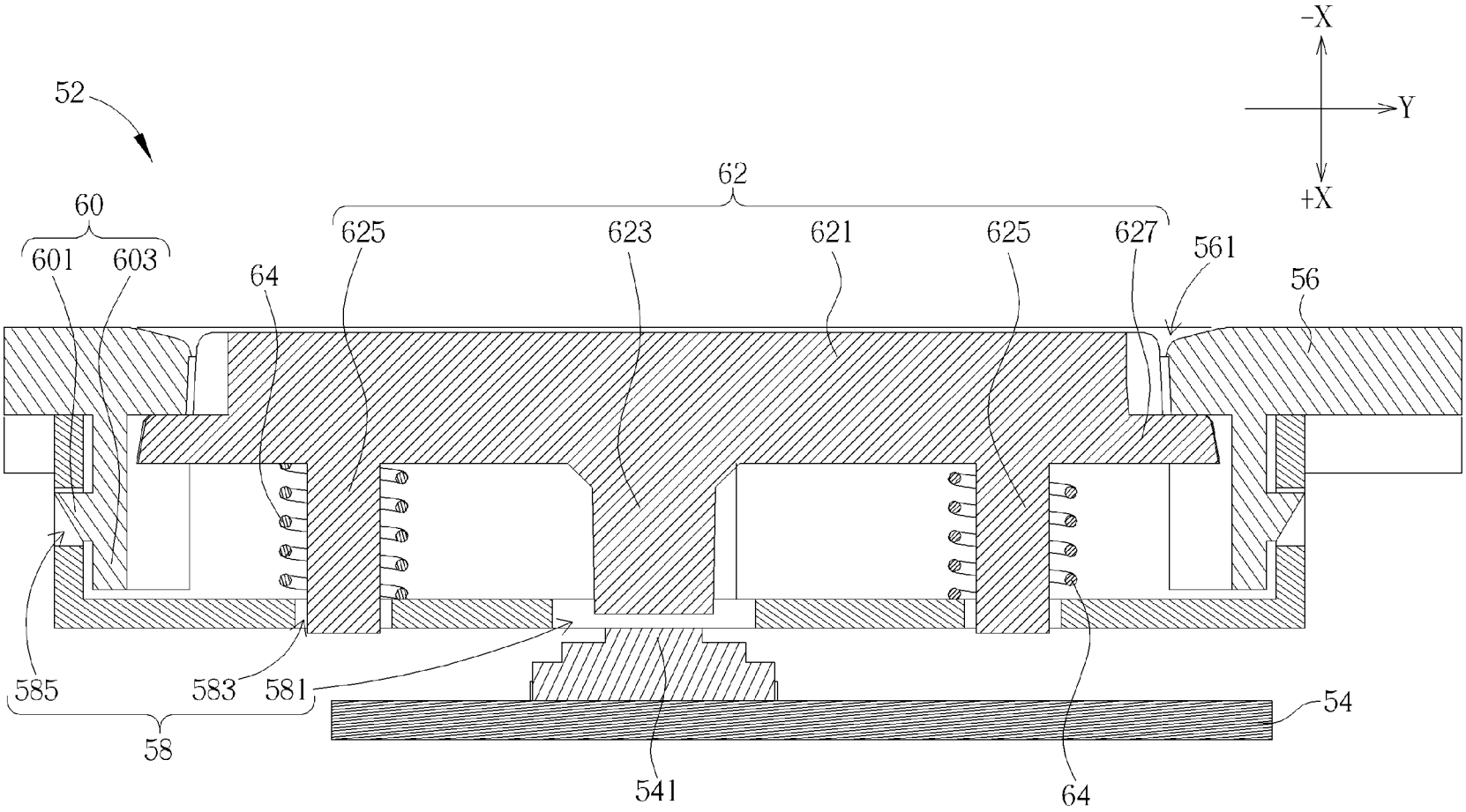
FIG. 6 and FIG. 7 are sectional views of the button mechanism in different states according to the embodiment of the present invention.
Figure 7:
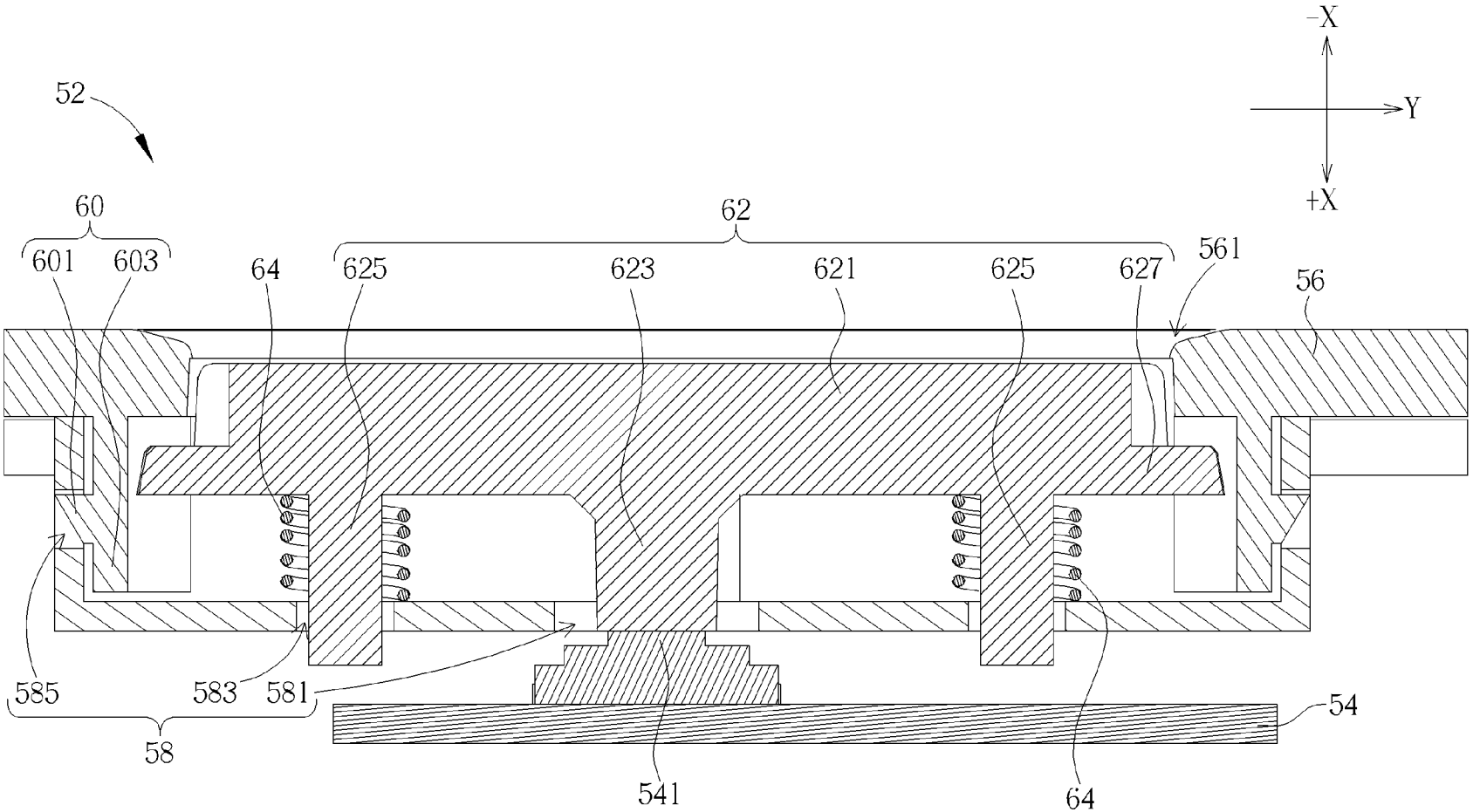

Please refer to FIG. 4 to FIG. 7. FIG. 4 and FIG. 5 are assembly diagrams of the button mechanism 52 according to the embodiment of the present invention. FIG. 6 and FIG. 7 are sectional views of the button mechanism 52 in different states according to the embodiment of the present invention. As for assembly of the button mechanism 52, as shown in FIG. 4, the resilient component 64 sheathes the guiding pillar 625 of the button 62 first, and a combination of the button 62 and the resilient component 64 is installed inside the fixing structure 60 and on the casing 56. That is, the protruding rib 603 of the fixing structure 60 can be disposed around the main body 621 of the button 62 and constrain the main body 621 from shifting on the Y-Z plane. The button 62 is assembled at the inner side of the casing 56, so that it can prevent the assembly of the button 62 from scratching the outer surface of the casing 56, so as to increase the production yield rate. Next, as shown in FIG. 5, the frame 58 can be installed around the button 62 and the resilient component 64 in the −X direction, so as to protect the button 62 and the resilient component 64. At this time, the engaging hole 585 of the frame 58 is engaged with the hook 601 of the fixing structure 60, the actuating portion 623 of the button 62 is aligned to the hole 581 of the frame 58, the guiding pillar 625 passes through the aperture 583 of the frame 58, the constraining portion 629 of the button 62 is installed inside the guiding portion 587 of the frame 58, and the two ends of the resilient component 64 contact against the inner side of the frame 58 and the main body 621 of the button 62 respectively.

When users press the main body 621 of the button 62 in the X direction for switching a state of the button mechanism 52 in FIG. 6 to a state of the button mechanism 52 in FIG. 7, the actuating portion 623 of the button 62 is driven to pass through the hole 581 of the frame 58 in the X direction, so as to actuate a switch 541 on the circuit board 54 to generate the corresponding ON or OFF signal. At this time, the guiding pillar 625 passes through the aperture 583 of the frame 58 and does not interfere with the frame 58 structurally, and the main body 621 of the button 62 presses the resilient component 64 in the X direction, so that the resilient component 64 is compressed. When users finish pressing the main body 621 of the button 62 and release the button 62, the resilient component 64 provides the main body 621 of the button 62 with a resilient restoring force to drive the button 62 to move in the −X direction, so as to return the button 62 to a position illustrated in FIG. 6. And the extension portion 627 also moves in the −X direction to contact against the inner side of the casing 56, so as to prevent the button 62 from separating from the opening 561. When the extension portion 627 contacts against the inner side of the casing 56, the surface of the main body 621 of the button 62 substantially aligns with the outer surface of the casing 56, so as to maintain the uniformity of overall appearance of the button mechanism 52 without any step. As a result, an operation of the button mechanism 52 has been described above in detail.

In contrast to the prior art, the button mechanism of the present invention utilizes the detachable frame to fasten the button inside the casing and utilizes the resilient component contacting against the frame and the button to provide the button with a pressing and returning mechanism, so as to improve the problem of no reworking capability of a conventional mechanism with a flexible arm structure connected to the casing in a heat melt manner. That is, it only needs to detach the frame and install a new button without replacing any other appearance component of the casing when replacing the old button, so as to save assembly cost efficiently and increase assembly convenience.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A button mechanism, comprising:

a casing whereon an opening is formed;

a frame installed inside the casing and located in a position corresponding to the opening, a hole being formed on the frame, and at least one aperture being further formed on the frame;

a fixing structure disposed on the casing for fixing the frame;

a button installed inside the frame and located in a position corresponding to the opening, the button comprising:

a main body; and an actuating portion connected to a side of the main body, the actuating portion passing through the hole on the frame as the main body is pressed in a first direction, so as to actuate a switch; and at least one resilient component installed inside the frame, and two ends of the at least one resilient component contacting against an inner side of the frame and the main body respectively, so as to drive the button to move in a direction opposite to the first direction;

wherein the button further comprises at least one guiding pillar connected to the side of the main body and passing through the at least one aperture, and the at least one resilient component sheathes the at least one guiding pillar.

2. The button mechanism of claim 1, wherein at least one engaging hole is formed on a lateral wall of the frame, and the fixing structure comprises at least one hook for engaging with the at least one engaging hole, so as to constrain a movement of the frame in the first direction.

3. The button mechanism of claim 2, wherein the fixing structure further comprises at least one protruding rib disposed at a side of the opening, and the at least one protruding rib is for constraining a movement of the main body of the button in a direction vertical to the first direction.

4. The button mechanism of claim 3, wherein the at least one hook is connected to a side of the at least one protruding rib furthest from the opening.

5. The button mechanism of claim 1, wherein the fixing structure comprises at least one protruding rib disposed at a side of the opening, and the at least one protruding rib is for constraining a movement of the main body of the button in a direction vertical to the first direction.

6. The button mechanism of claim 5, wherein at least one engaging hole is formed on a lateral wall of the frame, and the fixing structure further comprises at least one hook for engaging with the at least one engaging hole, so as to constrain a movement of the frame in the first direction.

7. The button mechanism of claim 6, wherein the at least one hook is connected to a side of the at least one protruding rib furthest from the opening.

8. The button mechanism of claim 1, wherein the frame comprises at least one guiding portion, the button further comprises an extension portion from which and at least one constraining portion protrudes, the extension portion is connected to a side of the main body and abuts against an inner side of the casing as the at least one resilient component drives the button to move in the direction opposite to the first direction thus restraining the button within the opening, the at least one constraining portion protruding from the extension portion, moves within the at least one guiding portion, and the at least one guiding portion of the frame restrains the at least one constraining portion to move along the first direction.

9. The button mechanism of claim 8, wherein the at least one guiding portion and the at least one constraining portion are respectively a U-shaped guiding track and an extension rib.

10. The button mechanism of claim 8, wherein as the extension portion contacts against the inner side of the casing, a surface of the main body of the button is substantially aligned with an outer surface of the casing.

11. An electronic device, comprising:

a circuit board whereon a switch is disposed; and a button mechanism for actuating the switch, the button mechanism comprising:

a casing whereon an opening is formed;

a frame installed inside the casing and located in a position corresponding to the opening, and a hole being formed on the frame;

a fixing structure disposed on the casing for fixing the frame;

a button installed inside the frame and located in a position corresponding to the opening, the button comprising:

a main body; and an actuating portion connected to a side of the main body, the actuating portion passing through the hole on the frame as the main body is pressed in a first direction, so as to actuate the switch; and at least one resilient component installed inside the frame, and two ends of the at least one resilient component contacting against an inner side of the frame and the main body respectively, so as to drive the button to move in a direction opposite to the first direction;

wherein the frame comprises at least one guiding portion, the button further comprises an extension portion from which and at least one constraining portion protrudes, the extension portion is connected to a side of the main body and abuts against an inner side of the casing as the at least one resilient component drives the button to move in the direction opposite to the first direction thus restraining the button within the opening, the at least one constraining portion protruding from the extension portion, moves within the at least one guiding portion, and the at least one guiding portion of the frame restrains the at least one constraining portion to move along the first direction.

12. The electronic device of claim 11, wherein at least one engaging hole is formed on a lateral wall of the frame, and the fixing structure comprises at least one hook for engaging with the at least one engaging hole, so as to constrain a movement of the frame in the first direction.

13. The electronic device of claim 11, wherein the at least one guiding portion and the at least one constraining portion are respectively a U-shaped guiding track and an extension rib.

14. The electronic device of claim 11, wherein as the extension portion contacts against the inner side of the casing, a surface of the main body of the button is substantially aligned with an outer surface of the casing.

15. The electronic device of claim 11, wherein at least one aperture is further formed on the frame, the button further comprises at least one guiding pillar connected to the side of the main body and passing through the at least one aperture, and the at least one resilient component sheathes the at least one guiding pillar.

16. The electronic device of claim 11, wherein the fixing structure comprises at least one protruding rib disposed at a side of the opening, and the at least one protruding rib is for constraining a movement of the main body of the button in a direction vertical to the first direction.

17. The electronic device of claim 16, wherein at least one engaging hole is formed on a lateral wall of the frame, and the fixing structure further comprises at least one hook for engaging with the at least one engaging hole, so as to constrain a movement of the frame in the first direction.

18. The electronic device of claim 17, wherein the at least one hook is connected to a side of the at least one protrude furthest from the opening.

* * * * *